United States Patent [19]

Rankin

[11] 4,036,761

[45] July 19, 1977

[54] GUTTER GUARD

[75] Inventor: Armand T. Rankin, New Albany, Ind.

[73] Assignee: Stone City Products, Inc., Bedford, Ind.

[21] Appl. No.: 707,779

[22] Filed: July 22, 1976

[51] Int. Cl.[2] ..... B01D 25/04; B01D 23/00

[52] U.S. Cl. ..... 210/474; 24/81 R; 52/12

[58] Field of Search ..... 210/474, 473, 475, 455; 52/12; 24/81

[56] References Cited

U.S. PATENT DOCUMENTS

| | | | |
|---|---|---|---|
| 1,867,636 | 7/1932 | Tinklepaugh et al. | 210/474 |
| 2,583,422 | 1/1952 | Haddon | 210/474 X |
| 2,948,083 | 8/1960 | Steele | 210/474 X |
| 3,420,378 | 1/1969 | Turner | 210/474 |
| 3,428,183 | 2/1969 | Bristow | 210/474 |
| 3,630,383 | 12/1971 | Reeves | 210/474 |
| 3,741,398 | 6/1973 | Abramson | 210/474 |

*Primary Examiner*—Theodore A. Granger

*Attorney, Agent, or Firm*—Donald L. Cox

[57] ABSTRACT

An improved guard for guttering having a U-shaped clip for holding the guard in rotational contact with the front flanged edge of the gutter is disclosed. The guard is comprised of a screen member attached to the front edge of the gutter and extending across the gutter mouth to the leading edge of the roof. The U-shaped clip is equipped with two rotational nodes, wherein the first node is located on the gutter flange so that the screen rotates into contact with the leading edge of the roof, and the second node is located directly to the rear of the first node on the outer edge of the gutter flange so that the screen can rotate as much as 135° from full closed position over the gutter to a fully open position substantially perpendicular to the ground. The screen is comprised of intersecting cross members which intersect with the line of the leading edge of the roof at angles of from about 10° to about 80° and about 170° to about 100°, respectively, wherein said members are inclined or declined with respect to the plane formed by the front flanged edge of the gutter and the leading edge of the roof.

2 Claims, 3 Drawing Figures

GUTTER GUARD

BACKGROUND OF INVENTION

This invention relates to gutter guards. More particularly, this invention relates to an improvement on the gutter guard disclosed in U.S. Pat. No. 3,630,383.

Gutterings arranged around a building, home or business for catching runoff water from the roofs have been deficient in several aspects. Most particularly, structures located in areas near to trees have often become clogged by an excess buildup of leaves within the gutter. This buildup causes the gutter itself to function improperly, often allowing trapped water to run over the end of the gutter, rather than to be transported to a downspout.

Various attempts have been made to provide screen guards or covers for gutters.

While such guards are successful in keeping the larger foreign elements from the gutter, they have been found to be deficient in other respects. U.S. Pat. No. 2,734,467 to H. M. Steel and U.S. Pat. No. 3,420,378 to E. L. Turner, have set out various types of gutter guards. However, the guards suggested there are thick, relatively unsightly, or flimsy and difficult to open.

U.S. Pat. No. 3,630,383, on which this patent is an improvement, discloses a gutter guard which is deficient in that it allows rain water to run across the gutter screen without passing through the screen. Furthermore, the clip which attaches the gutter guard to the gutter does not allow full opening of the guard for cleaning.

Finally, the gutter guard disclosed in this patent employs a hem on the roof side of the screen. This hem causes a buildup of trash along its leading edge, further decreasing the amount of water which is allowed to pass through the screen into the gutter. The design of the screen itself makes installation difficult, because the screening cross members are in commercial construction of uneven assembly.

Thus, it is an object of this invention to provide an improved gutter guard.

It is another object of this invention to provide an effective means for attaching the guard to the gutter, so that the gutter itself may be easily and readily cleaned.

It is another object of this invention to provide a gutter guard which easily allows water to pass through it directly into the gutter without any surface water runoff.

It is another object of this invention to provide gutter guards which reduce the capillary loss of water previously experienced by prior art gutter guards.

it is still another object of this invention to prepare gutter guards which do not allow excessive buildup of trash at the point of contact between the gutter screen and the roof.

These and other objectives are obtained by preparing the apparatus of the instant invention.

DETAILED DESCRIPTION OF DRAWINGS

DESCRIPTION OF INVENTION

Figure 1:
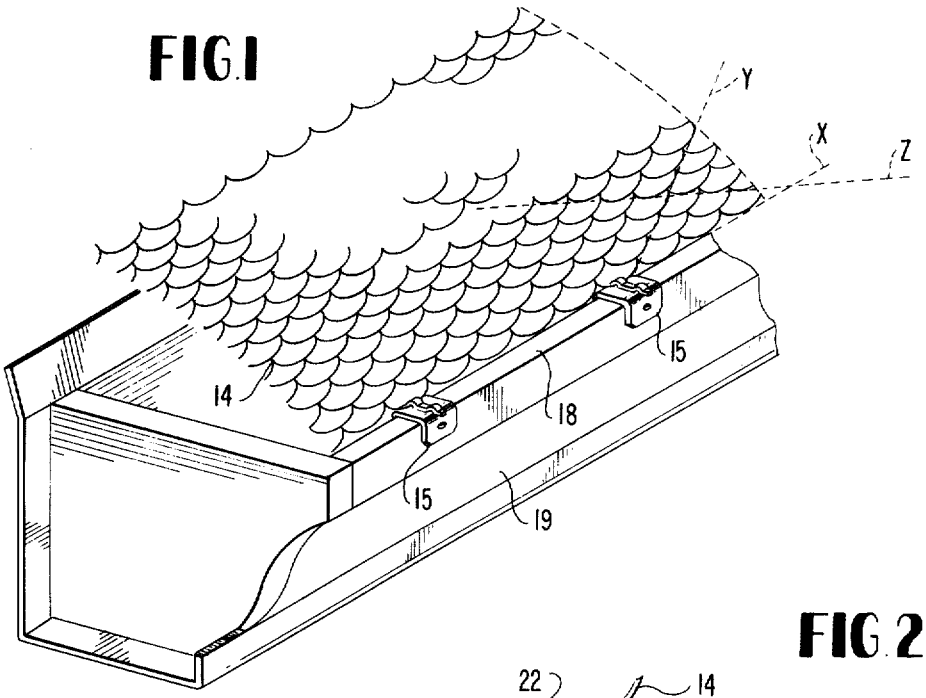
FIG. 1 is a prospective view of improved gutter guard as described in the instant invention installed upon a gutter.
Figure 2:
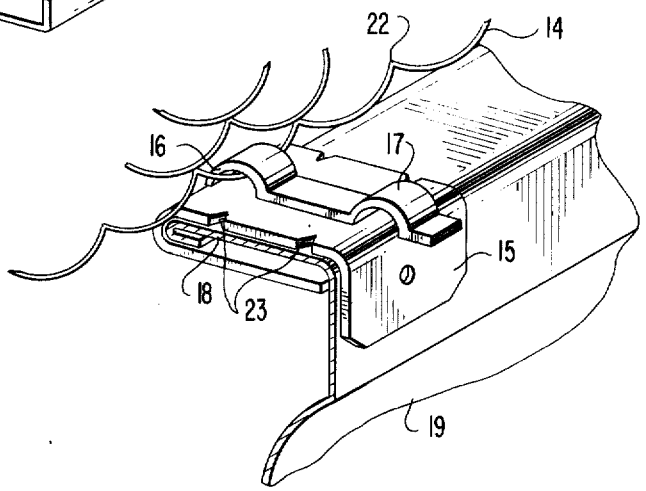
FIG. 2 is an enlarged prospective view illustrating the attachment of the gutter guard to the gutter in detail.

The drawing illustrates the improved guard for a gutter. The gutter guard system of the instant invention is basically composed of two parts: the screen 14 and the U-shaped clip 15 for attaching the screen to the gutter. Because of prior art problems with trash buildup, no hem is provided along the edge of the screen resting on the roof.

Figure 3:
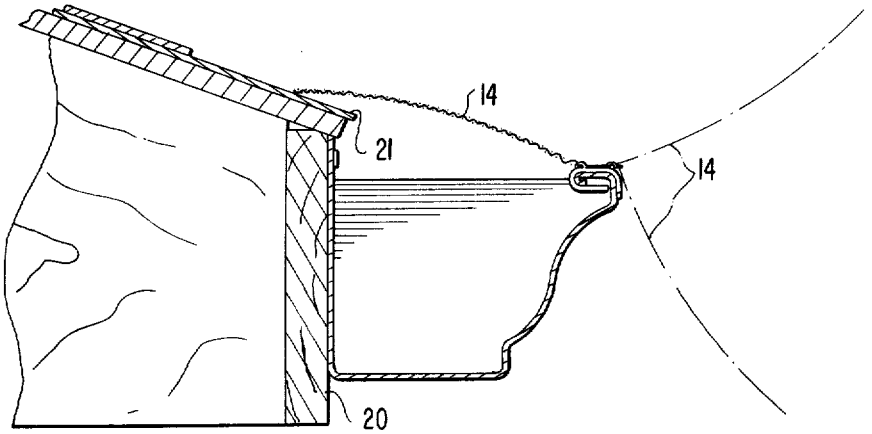
FIG. 3 is a traverse sectional elevation further illustrating the positioning of the gutter guard with respect to the gutter and the roof and the opening of the gutter guard to a position essentially perpendicular to the ground to allow gutter cleaning.

The U-shaped clip 15 is provided with two rotational nodes 16 and 17. The first rotational node 16 is located on the inward edge of the flange 18 of the gutter 19. The second node 17 is located directly to the rear of the first node on the outer edge of the gutter flange, so that when the gutter screen is moved to the second node position, it can rotate as much as 135° from fully closed to fully opened and essentially perpendicular to the ground. (See FIG. 3) Thus, the guard is easily opened for cleaning, in that it rotates fully to the down perpendicular position. The nodes are formed on the U-shaped clip by a pair of loop areas which allows free rotational movement of the screen. By applying pressure to the screen, it can be moved from the forward to the rear node or vice versa. The U-shaped clip is attached to one or more positions in a screen and the clip itself may be attached to the gutter flange by various means, including preferably a teethed 23 U-shaped receiving area which binds to the gutter flange, forestalling removal. The clip may be formed from any material, but is preferably formed from heat-treated spring steel. In instances where the clip is utilized on a wooden gutter, it is preferred that it be attached to the gutter by means of a nail or screw inserted through a hole in the clip. The hole may be on either the leading edge of the clip or on the top edge as convenience dictates.

The gutter itself may be of any convenient shape.

The gutter is attached to the facing molding of the house 20 by any conventional means just under the leading edge of a structure roof 21. It is usually attached just below the roof and under the roof overhang.

The screening which forms the second major component of the instant invention is formed of intersecting cross members 22 which themselves intersect with the line of the gutter flange at angles of from about 10° to about 80° and about 100° to about 170° respectively. Said members are inclined or declined to the plane formed from the leading edge of the roof to the front flanged edge of the gutter.

In FIG. 1 dotted line X is the line of the gutter flange. Dotted line Y is an extension of the line of one of the cross members, and dotted line Z is an extension of the line of the other cross member. Dotted line Y forms an angle with the gutter flange. This angle can be from about 10° to about 80°. The angle that Z forms with line X can range from about 100° to 170°. The remaining cross members form similar angles of intersection with X and are parallel to the cross members forming the Y, Z lines.

By providing the gutter guard with screening formed from members which are declined or inclined with respect to the plane, capillary action along the screen face is reduced or eliminated, so that nearly all water which comes in contact with the face of the screen member passes through it into the gutter. Thus the cross members are slightly flattened. Stating that the members are inclined or declined with respect to the plane formed from the leading edge of the roof to the front flanged edge of the gutter, means that the flattened faces of the cross members are turned slightly upward or downward to direct the flow of water across the screen into the gutter.

By utilizing the gutter guard as described herein, it is possible because of the accessibility of the guttering itself to more readily clean the gutter. Prior art problems of water capillary action across the face of the gutter guard screen are alleviated because of the screening design.

The above description and drawings are meant to be merely illustrative and not as any limit on the general invention as described herein.

What is claimed is:

1. In combination with a flanged gutter attached to the leading edge of a sloped roof of a building, a screen guard therefor utilizing an elongated screen extending along the length of said gutter and there across, said screen consisting of two diagonally intersecting members forming the apex of a triangle-shaped aperture, and the member constructed and arranged to provide a base for said triangular-shaped opening of said screen, a plurality of substantially U-shaped clips spaced along the length of the flange of said gutter, the upper portion of said clips consisting of a horizontal member with one end resiliently connected to the spring clip, and with at least one rotational node constructed and arranged between the ends of said horizontal member, the third member of said screen forming the base of the triangular-shaped opening therein, located under said rotational node and above the upper surface of the flange of said gutter whereby said screen may be rotated into two rotational positions, one position being located on the edge of the gutter flange nearest the roof and the other position being located directly to the rear of the first node on the outer edge of the flange.

2. The guard of claim 1 wherein the U-shaped clip is held in place on the gutter flange by means of teeth located in said U-shaped clip.

* * * * *